US005081833A

United States Patent [19]

Mezzedimi et al.

[11] Patent Number: 5,081,833

[45] Date of Patent: Jan. 21, 1992

[54] DEVICE FOR KEEPING THE ANNULAR OUTLET MOUTH OF THE GAS VOLUTE ALWAYS CENTERED ABOUT THE NOZZLE ASSEMBLY IN A GAS TURBINE

[75] Inventors: Vasco Mezzedimi, Siena; Franco Frosini, Florence, both of Italy

[73] Assignee: Nuovopignone-Industrie Meccaniche e Fonderia S.p.A., Florence, Italy

[21] Appl. No.: 622,181

[22] Filed: Dec. 3, 1990

Related U.S. Application Data

[63] Continuation of Ser. No. 339,000, Apr. 17, 1989, abandoned.

[51] Int. Cl.[5] ..... F02C 7/32

[52] U.S. Cl. ..... 60/39.32; 60/39.75

[58] Field of Search ..... 6/39.32, 39.36, 39.75; 285/223, 261, 266, 302

[56] References Cited

U.S. PATENT DOCUMENTS

| | | | |
|---|---|---|---|
| 3,186,168 | 6/1915 | Ormerad et al. | 60/39.32 |
| 3,965,066 | 6/1976 | Sterman et al. | 60/39.32 |
| 4,016,718 | 4/1977 | Lauck | 60/39.37 |
| 4,191,011 | 3/1980 | Sweeney et al. | 60/39.32 |
| 4,422,288 | 12/1983 | Steber | 60/39.37 |
| 4,688,378 | 8/1987 | Harris | 60/39.75 |
| 4,712,370 | 12/1987 | Macbee | 60/39.32 |

FOREIGN PATENT DOCUMENTS

| | | | |
|---|---|---|---|
| 1243024 | 6/1967 | Fed. Rep. of Germany | 60/39.32 |
| 1052694 | 11/1983 | U.S.S.R. | 60/39.32 |
| 2035474 | 6/1980 | United Kingdom | 60/39.32 |

*Primary Examiner*—Louis J. Casaregola
*Assistant Examiner*—Timothy S. Thorpe
*Attorney, Agent, or Firm*—Hedman, Gibson, Costigan & Hoare

[57] ABSTRACT

A device for keeping the annular outlet mouth of the gas volute always centered about the nozzle assembly in a gas turbine, consisting of two diametrically divided retaining rings embracing said annular mouth, the lower half-ring having an inner radius greater than that of the upper half-ring, this latter forming predetermined radial gap with said annular mouth.

1 Claim, 4 Drawing Sheets

Figure 1:
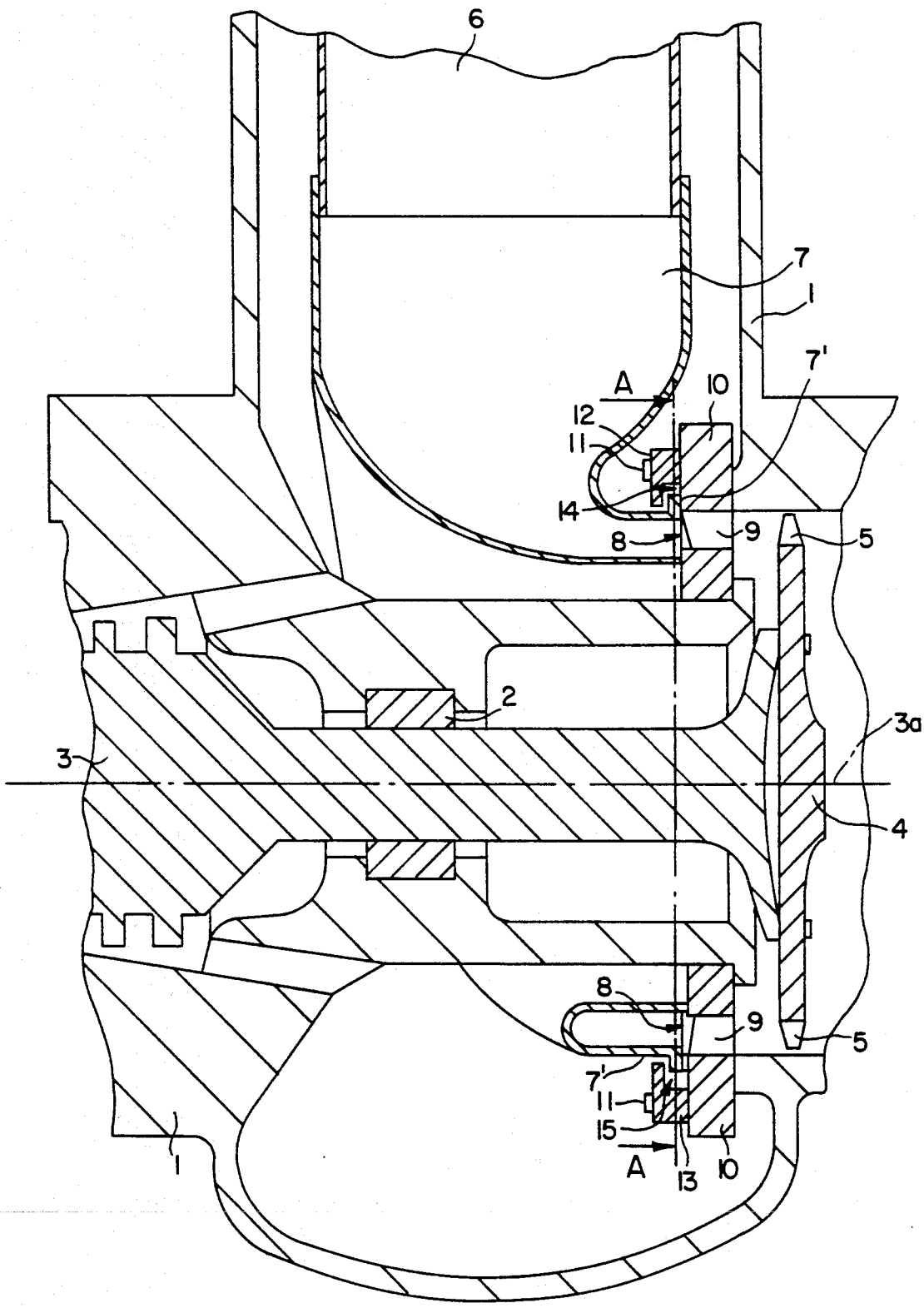

DEVICE FOR KEEPING THE ANNULAR OUTLET MOUTH OF THE GAS VOLUTE ALWAYS CENTERED ABOUT THE NOZZLE ASSEMBLY IN A GAS TURBINE

This is a continuation application of U.S. Ser. No. 07/339,000 filed Apr. 17, 1989, now abandoned.

This invention relates to a device which enables the annular outlet mouth of the gas volute to be kept always centered about the nozzle assembly even in gas turbines of high compression ratio and high fire temperature in which high loads act on the volute. In all gas turbines provided with a single combustion chamber there is a volute the function of which is to distribute the hot gases from the combustion chamber annularly to the array of nozzles.

As the volute, together with the combustion chamber walls, represents the hottest part of the turbine it must necessarily be of the lightest possible sheet metal construction to limit thermal stresses to a minimum, with the result that it is unable to withstand high localized loads. The thermal stresses result from differential thermal expansion.

Again, the connection between the annular outlet mouth of the volute and the nozzle support cannot be rigid because as their masses are different and they operate under different working conditions, these two members assume very different temperatures with consequent considerable differential expansion.

There is therefore the problem of keeping the annular outlet mouth of the volute centered about the array of nozzles, and ensuring that it is so, because misalignment results in loss of turbine efficiency due to the sharp steps created in the gas passage duct. The volute is subjected to mechanical loads deriving from its weight (generally negligible) and in particular from the gas pressure and overall motion differences between the inlet and outlet. These mechanical loads, which become greater the higher the turbine working pressures and thus the higher its compression ratio, create an upward force which moves the annular outlet mouth of the volute upwards.

In the current state of the art the classical system usually used to guide said movement and to keep any two parts subjected to considerable differential expansion concentric with each other is to connect said parts together by a set of radial keys which make it possible for the two parts to undergo relative sliding while remaining concentric.

Such a method cannot however be applied to gas turbines of high compression ratio and high fire temperature because the consequent considerable loads acting on the volute would have to be transmitted through said radial keys and specifically through only those keys in a horizontal plane, and this load concentration at the keys would induce intolerable stress states in the volute which as stated has to be of very light construction because of the high gas temperature.

The object of the present invention is to obviate said drawback by providing a device for connecting the annular outlet mouth of the volute to the nozzle support which although dispensing with the use of keys enables effective centering to be maintained, even in gas turbines of high compression ratio.

This is attained substantially in that said connection is made by two retaining half-rings which are fixed to the nozzle support to embrace the annular outlet mouth of the volute, the upper half-ring forming with the outer flange of said mouth a predetermined gap which compensates the differential expansion between the volute and nozzle support, to thus keep said volute centered about the nozzles during normal working.

In this respect, during normal working the annular outlet mouth of the volute rests against the upper half-ring by the effect of said upward force, and therefore if the temperatures attained by the volute and the nozzle support ring are known, an exact calculation can be made of the gap to be left between the outer flange of the volute mouth and the upper half-ring so that said mouth is centered about the nozzles during normal working.

According to a further characteristic of the present invention said lower retaining half-ring has an inner radius greater than that of the upper half-ring. In this manner, if differential expansion occurs between the annular outlet mouth of the volute and the retaining half-ring which is greater than that predicted, the risk of serious coaction is avoided because the annular mouth can further expand into the greater empty space available.

Thus, the device for keeping the annular outlet mouth of the gas volute always centered about the nozzle assembly in a gas turbine is characterised according to the present invention by comprising two retaining half-rings which are fixed to the nozzle support ring to embrace said annular mouth, the lower half-ring having an inner radius greater than that of sthe upper half-ring, which forms with the outer flange of said annular outlet mouth of the volute a predetermined gap arranged to compensate the differential expansion between said annular mouth and said nozzle support ring. The invention is described in detail hereinafter with reference to the accompanying drawings which illustrate a preferred embodiment thereof given by way of non-limiting example in that technical or constructional modifications can be made thereto but without leaving the scope of the present invention.

Figure 1A:
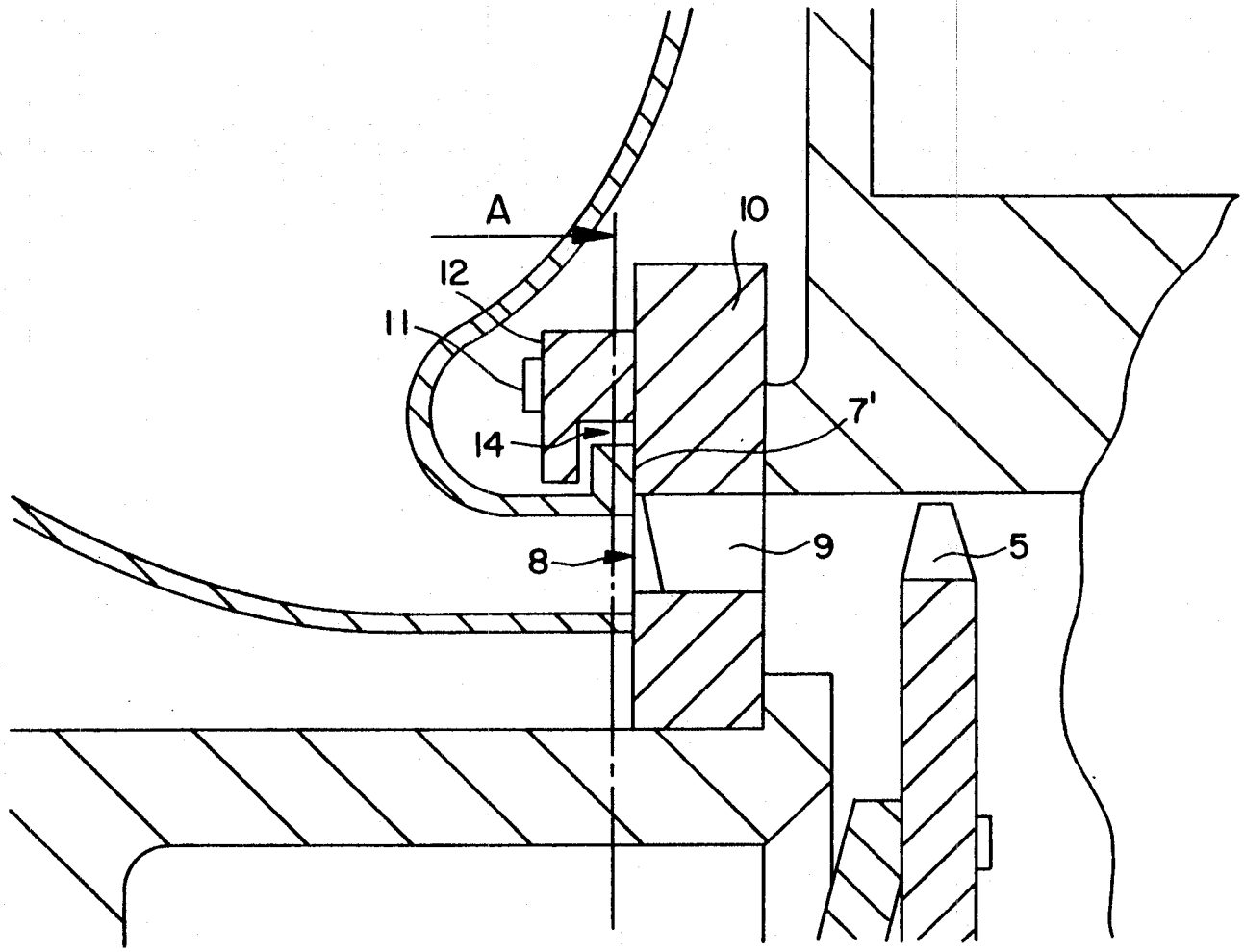
Figure 1B:
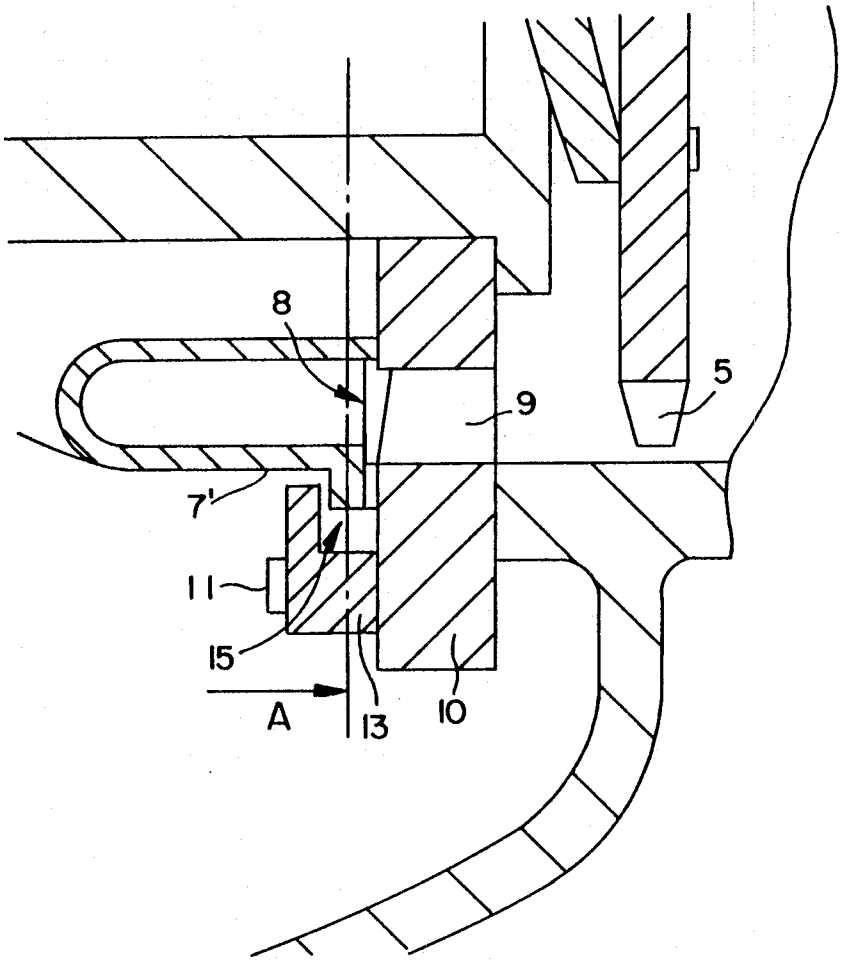
Figure 2:
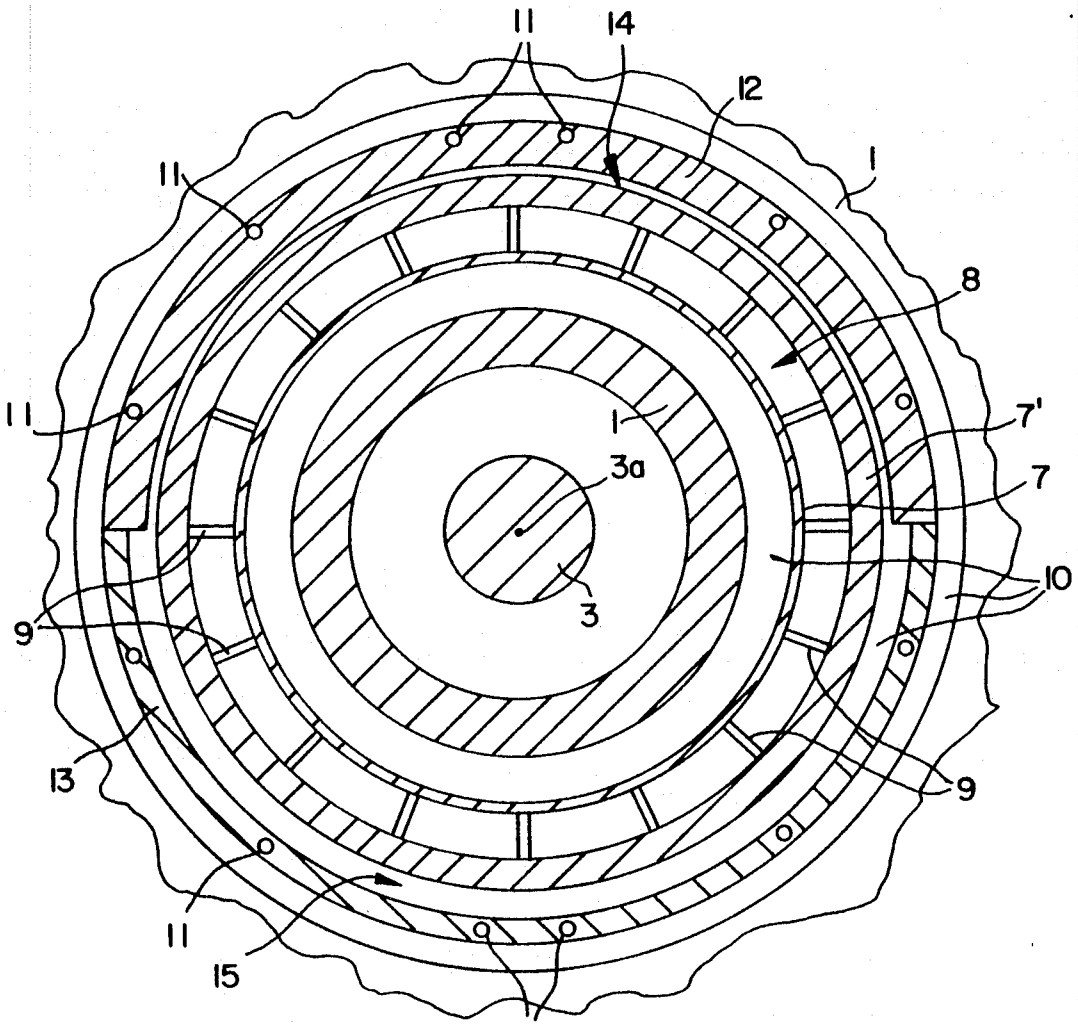

In said drawings:

FIG. 1 is partial lateral section through a gas turbine using the device of the invention;

FIG. 1*a* is an enlarged detail drawing showing the gap 14 shown in FIG. 1;

FIG. 1*b* is an enlarged detail drawing showing the gap 15 shown in FIG. 1;

FIG. 2 is a partial front section on the line A—A of FIG. 1.

In the figures, the reference numeral 1 indicates a gas turbine casing which on bearings 2 rotatably supports the shaft 3 carrying the discs 4 of the turbine blades 5. Line 3*a* is the centerline of the shaft 3. The combustion chamber 6 is connected to a gas volute 7 the annular outlet mouth 8 of which faces the zone comprising the nozzles 9, which are supported radially by a nozzle support ring 10 supported by the turbine casing 1.

In order to keep the annular outlet mouth 8 always centered about the nozzle assembly 9, two retaining diametrically divided half-rings 12 and 13 are fixed above and below of the centerline 3*a* of the shaft 3 on the nozzle support ring 10 by bolts 11 to embrace said annular mouth 8 in such a manner as to leave a predetermined gap 14 between the upper half-ring 12 and the outer flange 7' of said annular outlet mouth 8. In addition, the lower half-ring 13 has a larger inner radius than the upper half-ring 12 (see FIG. 2 specifically), so that a greater empty space 15 is available.

The present invention thus keeps the annular outlet mouth 8 of the volute 7 centered with respect to the nozzle assembly 9. The nozzle assembly 9 is mounted on the support ring 10 of the turbine.

The problem, as is well known in the art, is that there is a differential of thermal expansion between the several component parts of the turbine assembly. This is because they are constructed of different materials and are differently positioned. For example, the volute 7 is made of thin sheet material. Consequently, it is heavily stressed by heat and this results in a high level of thermal expansion. The thermal expansion of the volute greatly exceeds that of the nozzle support ring 10. Moreover, due to the pressure differentials and the momentum of the gases between the inlet and the outlet of the turbine the annular mouth 8 is subjected to an upwardly lifting force. Once steady-state conditions are reached however, both the ring 10 an the annular mouth 8 will have a known level of thermal expansion. This can be accurately determined by measuring the temperature at steady-state conditions. These differentials of thermal expansion must be compensated for in order to keep the aft end of the turbine assembly centered with respect to the nozzle assembly.

Therefore, in accordance with this invention the upper retaining half ring 12 is secured by bolts 11 to the external top section of the nozzle support ring 10 as shown in FIG. 1. This provides a gap 14 the width of which corresponds to the differential of thermal expansion between the nozzle support ring 10 and the annular mouth 8. When steady state conditions are reached, the outer edge of sthe annular mouth 8 will abut the half ring 12 and therefore constantly be kept centered relative to the nozzle 9. In this way the problem of relative centering is solved at steady-state conditions.

The invention also centers the annular mouth during the initial period between starting the gas turbine and the attainment of normal working or steady state conditions. During this initial period, the differential of thermal expansion between the annular mouth 8 and the nozzle support ring 10 is actually greater than that during the steady state condition. This is because the aft end of the volute 7 heats more rapidly than the ring 10. This differential results in a more rapid expansion of the annular mouth 8 than that of the ring 10. During this transitional phase, there is also more rapid expansion of the annular mouth 8 than that of the upper retaining half ring 12 with the concomitant stresses due to the interference between the annular mouth 8 and the upper retaining half ring 12. To solve this differential expansion problem during the initial period, the lower retaining half ring 13 is secured by bolts 11 to the lower portion of the ring 10 as shown in FIG. 1. Lower retaining half ring 13 is radially narrower than the upper retaining half ring 12. As shown in FIG. 2, the outside diameter of the upper and the lower retaining half rings are the same, but the inside diameter of the lower retaining half ring 13 is greater than the inside diameter of the upper retaining half ring 12. Therefore, a radial expansion gap 15 is provided exceeding the radial expansion gap 14. In this way, the aft end of the annular mouth 8 is able to expand without creating abnormal force upon the upper retaining half ring 12 during the operating.

Thus, a composite expansion compensating ring structure is provided which, by selection of different radial dimensions of annular sections, allows compensation of thermal expansion under both initial operating conditions and under normal or steady state conditions.

We claim:

1. A device for centering an annular outlet mouth of a gas volute relative to a nozzle assembly in a gas turbine wherein the nozzle assembly has a nozzle support ring surrounding the annular outlet mouth, comprising:

a) a first retaining diametrically divided ring attached to the nozzle support ring, wherein said first retaining ring has an outer radius and an inner radius; and b) a second retaining diametrically divided ring attached to the nozzle support ring, wherein said second retaining ring has an outer radius and an inner radius, wherein said outer radius of said second retaining ring is equal to said outer radius of said first retaining ring and said inner radius of said second retaining ring is greater than said inner radius of said first retaining ring thereby forming a gap wherein said gap is effective to compensate for differential expansion between the annular outlet mouth and the nozzle support ring.

* * * * *